US007322663B2

(12) United States Patent
Sanada

(10) Patent No.: US 7,322,663 B2
(45) Date of Patent: Jan. 29, 2008

(54) IMAGE FORMING APPARATUS HAVING PREVENTION OF MOVEMENT OF INK PRESSURE CHAMBERS

(75) Inventor: Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 192 days.

(21) Appl. No.: 10/950,482

(22) Filed: Sep. 28, 2004

(65) Prior Publication Data

US 2005/0104913 A1 May 19, 2005

(30) Foreign Application Priority Data

Sep. 29, 2003 (JP) ..... 2003-338835

(51) Int. Cl.
*B41J 29/38* (2006.01)
*B41J 2/045* (2006.01)

(52) U.S. Cl. ..... 347/10; 347/12; 347/68

(58) Field of Classification Search ..... 347/68
See application file for complete search history.

(56) References Cited

U.S. PATENT DOCUMENTS 5,831,650 A 11/1998 Reinten
6,331,052 B1 12/2001 Murai et al.
6,578,953 B2 * 6/2003 Kitahara et al. ..... 347/68
2003/0048318 A1 3/2003 Blom et al.

FOREIGN PATENT DOCUMENTS

| | | | |
|---|---|---|---|
| EP | 0 752 312 | A1 | 1/1997 |
| EP | 1 291 181 | A1 | 3/2003 |
| JP | 3-293144 | A | 12/1991 |
| JP | 9-99554 | A | 4/1997 |
| JP | 11-157076 | A | 6/1999 |
| JP | 2003-145763 | A | 5/2003 |

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

The image forming apparatus comprises: nozzles arranged in a line fashion or a two-dimensional fashion; pressure chambers arranged respectively corresponding to the nozzles; and piezoelectric elements each of which causes ink to be discharged from the nozzle by imparting pressure to interior of the pressure chamber corresponding to the nozzle during a drive signal is impressed, wherein, when one of the nozzles discharges the ink, a drive signal is supplied to the piezoelectric element of a non-discharging nozzle neighborhood of the one of the nozzles discharging the ink, the drive signal including a drive component for driving the piezoelectric element of the non-discharging nozzle in an inverse direction to direction of the piezoelectric element of the one of the nozzles discharging the ink.

7 Claims, 10 Drawing Sheets

(B) LIMIT WITHOUT INTRODUCING AIR BUBBLE (A) LIMIT WITHOUT CAUSING DISCHARGE

IMAGE FORMING APPARATUS HAVING PREVENTION OF MOVEMENT OF INK PRESSURE CHAMBERS

This application claims priority from Japanese Patent Application No. 2003-337049, filed Sept. 29, 2003, the entire contents of which are herein incorporated by reference to the extent allowed by law.

BACKGROUND OF THE INVENTION

1. Field of the Invention

The present invention relates to an image forming apparatus, and more particularly, to an image forming apparatus such as an inkjet printer or the like, which forms an image on a recording medium by discharging ink onto the recording medium.

2. Description of the Related Art

An inkjet printer forms an image on recording paper by driving a recording head in accordance with image forming data, and causing ink to be discharged from nozzles of the recording head. The ink discharge device in a recording head includes devices based on a piezo actuator method, wherein the vibration plate of a pressure chamber is caused to deform by means of a piezoelectric element (piezo element), thereby applying pressure to the pressure chamber and hence causing ink to be discharged from the nozzle of the pressure chamber.

In an inkjet printer using a laminated type piezoelectric element, if a voltage is applied to a piezoelectric element during ink discharge, the piezoelectric element extends in the direction of lamination, but as a result of this movement, not only does the volume of the pressure chamber increase or decrease, but there is also a risk that the entire pressure chamber will move upward or downward, and if this latter effect is too great, then there is a risk that sufficient ink discharge capacity will not be obtainable. In order to prevent this, a composition is adopted wherein the side of the of the piezoelectric element opposite to the side where the vibration plate applies pressure to same, and the side walls of the pressure chamber, are fixed by means of a restricting member, thereby causing the pressure chamber to perform expanding and contracting deformation in a highly efficient manner. However, since the discharge performance will not be stable if the restricting member is not registered accurately in position, then manufacturing costs are required in order to implement this.

On the other hand, technology is known wherein, when drive energy is supplied to the piezoelectric element of a nozzle for discharging ink, a drive energy of a level which does not cause ink to be discharged is applied to the piezoelectric element of a nozzle that is not to discharge ink, thereby preventing the introduction of bubbles into the pressure chamber of a nozzle that is not to discharge ink (see Japanese Patent Application Publication No. 11-157076).

However, although the inkjet printer in Japanese Patent Application Publication No. 11-157076 is able to prevent the introduction of air bubbles into pressure chambers that are not to discharge ink, it does not necessarily do away with the need for the aforementioned restricting member.

SUMMARY OF THE INVENTION

The present invention is devised with the foregoing situation in view, an object thereof being to provide an image forming apparatus whereby unwanted upward and downward movement of the pressure chambers when discharging ink is prevented, without using restricting members, thereby allowing ink discharge efficiency to be improved.

In order to attain the aforementioned object, the present invention is directed to an image forming apparatus, comprising: nozzles arranged in a line fashion or a two-dimensional fashion; pressure chambers arranged respectively corresponding to the nozzles; and piezoelectric elements each of which causes ink to be discharged from the nozzle by imparting pressure to interior of the pressure chamber corresponding to the nozzle during a drive signal is impressed, wherein, when one of the nozzles discharges the ink, a drive signal is supplied to the piezoelectric element of a non-discharging nozzle neighborhood of the one of the nozzles discharging the ink, the drive signal including a drive component for driving the piezoelectric element of the non-discharging nozzle in an inverse direction to direction of the piezoelectric element of the one of the nozzles discharging the ink.

According to the present invention, since a drive signal for driving in the inverse direction to the piezoelectric element of discharging nozzle is supplied to the piezoelectric elements of non-discharging nozzles which are neighborhood of the nozzle discharging ink, then it is possible to prevent upward or downward movement of a pressure chamber when discharging ink, without using a restricting member, and hence the pressure chamber can be operated in an expanding and contracting action with good efficiency.

Preferably, at least a portion of drive waveform included in the drive signal supplied to the piezoelectric element of the non-discharging nozzle is of inverse phase to drive waveform included in drive signal for piezoelectric element of the discharging nozzle. According to this, at least a portion of drive waveform included in drive signal supplied to piezoelectric elements of the non-discharging nozzles is of inverse phase to drive waveform included in drive signal for piezoelectric element of the discharging nozzle, and hence upward and downward movement of the pressure chamber during ink discharge can be prevented, and the pressure chamber can be operated in an expanding and contracting action with good efficiency.

Preferably, magnitude of drive signal supplied to the piezoelectric element of the non-discharging nozzle is determined in accordance with distance between the non-discharging nozzle and the discharging nozzle. According to this, magnitude of drive signal supplied to the piezoelectric elements of non-discharging nozzles is determined in accordance with distance from the discharging nozzle, and therefore upward and downward movement of the pressure chamber during ink discharge can be prevented, and the pressure chamber can be operated in an expanding and contracting action with good efficiency.

Preferably, the image forming apparatus further comprises a dummy piezoelectric element that does not contribute to image formation arranged on outer side of the nozzles in outermost positions. According to this, since a dummy piezoelectric element that does not contribute to image formation is provided on outer side of nozzles in outermost positions, upward and downward movement of the pressure chamber at an outermost nozzle can be prevented, and the pressure chamber can be operated in an expanding and contracting action with good efficiency.

Here, the "discharge efficiency" of the pressure chamber indicates the ratio of the "discharge volume of the droplet" with respect to the "change in volume of the pressure chamber when pressurized", and the better the discharge efficiency, the more closely the discharge volume of the droplet approaches the change in volume of the pressure chamber.

Moreover, in the present specification, the term "recording" indicates the concept of forming images in a broad sense, including text. Moreover, "recording medium" indicates a medium on which an image is formed by means of a head (this medium may be called an image forming medium, recording medium, image receiving medium, recording paper, or the like), and this term includes various types of media, irrespective of material and size, such as continuous paper, cut paper, sealed paper, resin sheets, such as OHP sheets, film, cloth, and other materials.

According to the present invention, since a drive signal for driving in the inverse direction to the piezoelectric element of the discharging nozzle is supplied to the piezoelectric elements of non-discharging nozzles which are neighborhood of a nozzle discharging ink, then it is possible to prevent upward or downward movement of a pressure chamber in a direction other than the direction of pressurization during ink discharge, and hence the pressure chamber can be operated in an expanding and contracting action with good efficiency, without using a restricting member.

DETAILED DESCRIPTION OF THE PREFERRED EMBODIMENTS

Figure 1:
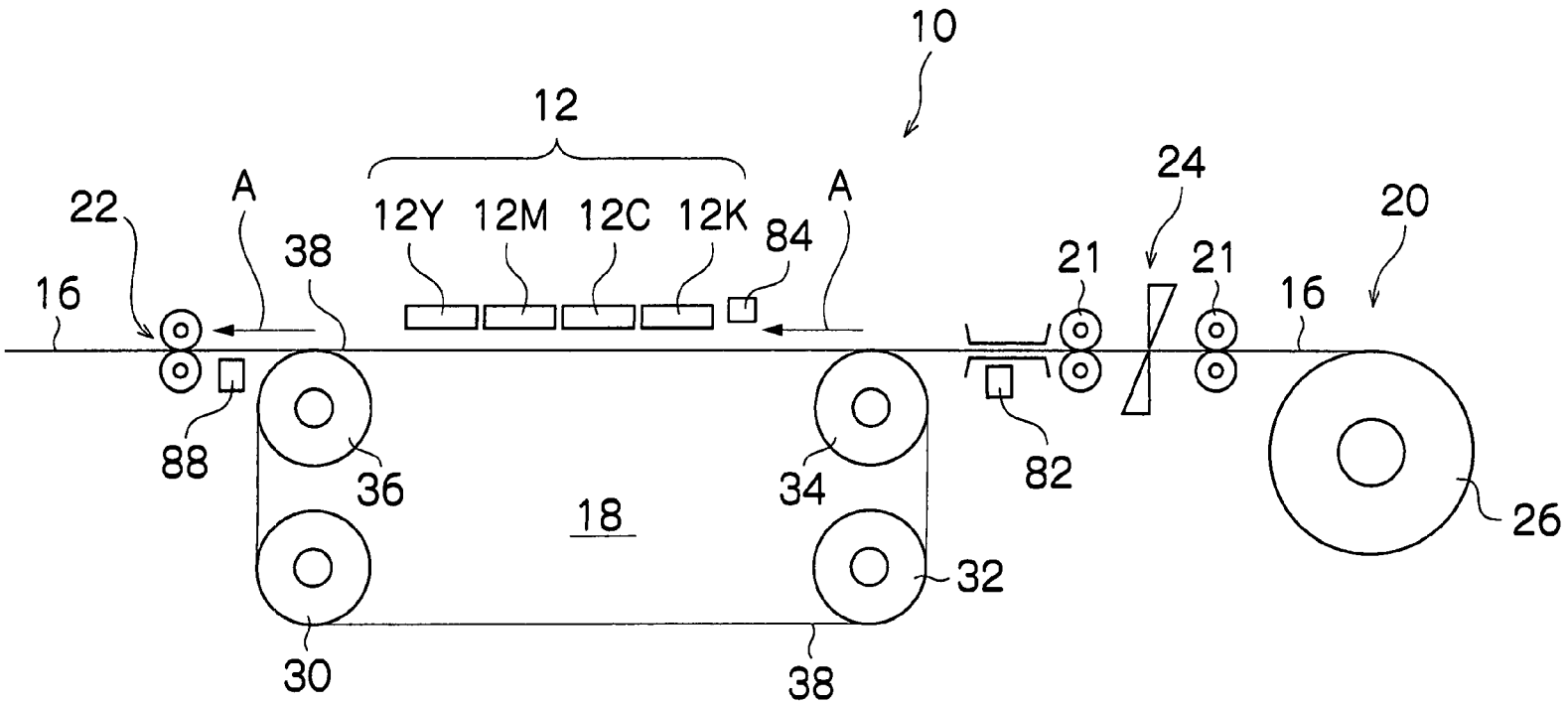
FIG. 1 is a side view showing an image forming apparatus relating to an embodiment of the present invention.

Below, an embodiment of an image forming apparatus relating to the present invention is described with reference to the accompanying drawings. FIG. 1 is a side view showing a schematic view of the composition of an image forming apparatus 10 to which this image forming apparatus is applied.

The image forming apparatus 10 comprises a recording head 12, a belt conveyance unit 18 for conveying recording paper 16 whilst maintaining the recording paper 16 in a flat state, disposed in a position opposing the recording head 12, a paper supply unit 20 for supplying recording paper 16, and a paper output section 22 for outputting recording paper externally, once an image has been formed thereon.

The recording head 12 is constituted by a so-called full line type head, wherein a line type head having a length corresponding to the width of the recording paper 16 is disposed in a fixed position, in a direction orthogonal to the paper conveyance direction. The recording heads 12K, 12C, 12M, 12Y corresponding to respective ink colors are disposed in the order, black (K), cyan (C), magenta (M) and yellow (Y), from the upstream side, following the direction of conveyance of the recording paper 16 (arrow A). A plurality of nozzles disposed in a staggered matrix arrangement are provided in a direction orthogonal to the conveyance direction on the lower face of each of these respective recording heads, and a color image, or the like, is formed on the recording paper 16 by discharging ink of respective colors from the nozzles, onto the recording paper 16, whilst conveying the recording paper 16.

A roll paper 26 is set in place detachably on a paper supply unit 20. Pickup rollers 21, 21 for picking up recording paper 16 from the roll paper 26 are provided in the vicinity of the paper supply unit 20. The driving force of a motor 114 (see FIG. 3) is transmitted to at least one of the pick-up rollers 21, and the recording paper 16 picked up thereby is conveyed from right to left in FIG. 1. Numeral 24 is a shearing cutter disposed between the rollers 21, 21, and the recording paper 16 picked up from the roller paper 26 is cut to a prescribed size by means of this cutter 24.

The belt conveyance unit 18 has a structure wherein an endless belt 38 is wound about rollers 30, 32, 34 and 36, and is composed in such a manner that at least the portion opposing the recording head 12 is a flat surface. This belt 38 has a broader width dimension than the width of the recording paper 16, and it conveys the recording paper 16. The drive force of a motor 116 (see FIG. 3) is transmitted to at least one of the rollers 30, 32, 34, 36 about which the belt 38 is wound, whereby the belt 38 is driven in an anti-clockwise direction in FIG. 1, and hence the recording paper 16 suctioned onto the belt 38 is conveyed from right to left in FIG. 1.

Numeral 82 denotes a recording detection unit for reading in the position, size, and the like, of the recording paper, numeral 84 denotes a recording position detection unit for determining the timing of ink discharge onto the recording paper 16, and numeral 88 denotes a recording paper end detection unit for determining the timing of stacking of the recording paper 16 and supply of the next sheet. Furthermore, a system controller (described hereinafter) which controls the whole image forming apparatus 10 on the basis of the detection results from the respective detection units is provided in the image forming apparatus 10. This system controller is constituted by a central processing unit (CPU) and peripheral circuits, and the like, and it generates, for example, drive signals and control signals for the respective motors for conveying the recording paper 16, and image forming signals for the recording head 12, and the like.

Figure 2:
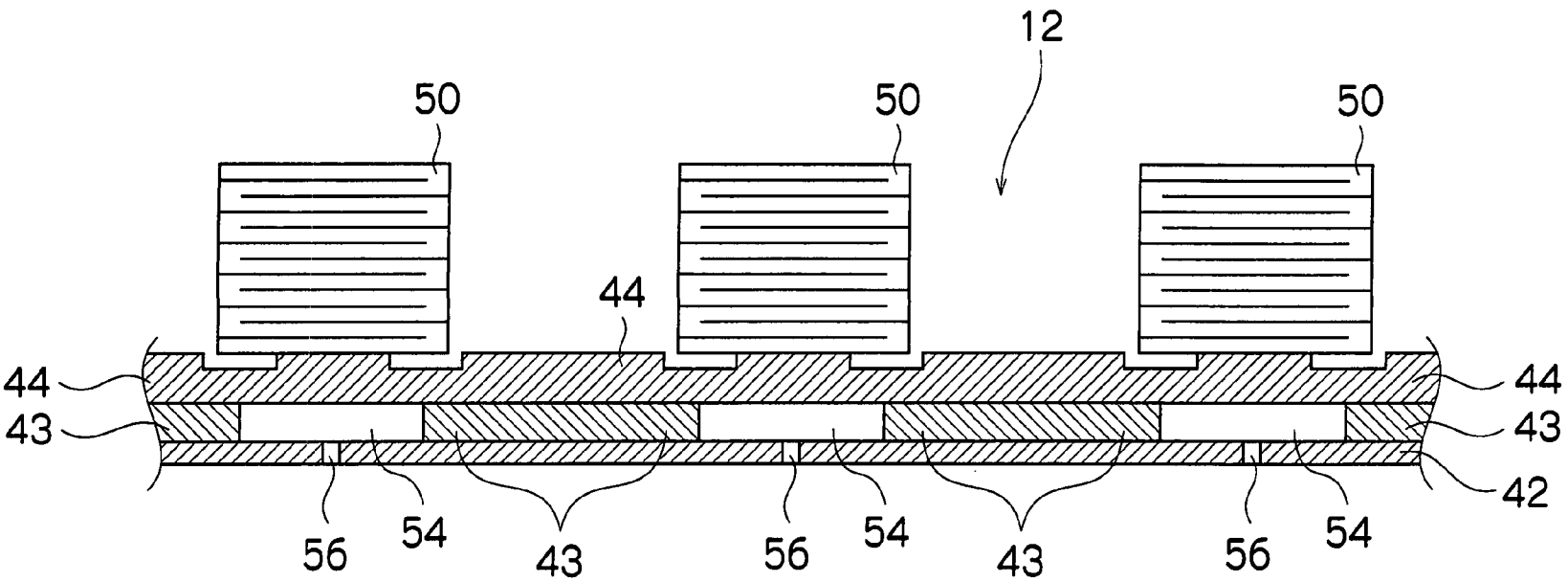
FIG. 2 is a plan view showing a recording head, which forms an image forming apparatus relating to an embodiment of the present invention.

As shown in FIG. 2, the recording head 12 is constituted by a nozzle plate 42, partitions 43, a vibration plate 44, a laminated type piezoelectric element 50, and the like. Pressure chambers 54 are formed by the spaces enclosed by the nozzle plate 42, the partitions 43 and the vibration plate 44. Nozzles 56 are formed in the nozzle plate 42 corresponding to the base section of the pressure chambers 54, each being connected to a pressure chamber 54. The vibration plate 44 is installed in such a manner that it seals the upper faces of the pressure chambers 54, and piezoelectric elements 50 are disposed on the upper face thereof.

The piezoelectric element 50 is a layered type piezoelectric element having a structure wherein thin plates of a piezoelectric body and an internal electrode are layered together in alternating fashion and bonded.

Furthermore, a flexible substrate (not illustrated) is connected to the end portion of the free end of the piezoelectric element 50 (the upper end in FIG. 2). A wiring pattern corresponding to the independent electrodes of the piezoelectric element 50 is formed on the flexible substrate, and all of the wires are guided externally, together, via the flexible substrate. The flexible substrate is made from a resin material having flexible properties, and it is connected and suspended across the plurality of piezoelectric elements 50.

The vibration plate 44 according to the present example also serves as a common electrode for the piezoelectric elements 50. The common electrode is connected electrically to a metallic vibration plate 44, via an adhesive. The adhesive may be caused to conduct due to the effect of surface roughening, or an electrically conductive adhesive may be used.

If a voltage is applied to the independent electrode of a piezoelectric element 50, then a potential difference is generated between the thin plates of the piezoelectric body inside the piezoelectric element 50, and the piezoelectric element 50 deforms in the direction of lamination (the vertical direction in FIG. 2). With the deformation of the piezoelectric element 50, the vibration plate 44 bends downward, and the pressure chamber 54 contracts, whereby ink is discharged from the nozzle 56.

Figure 3:
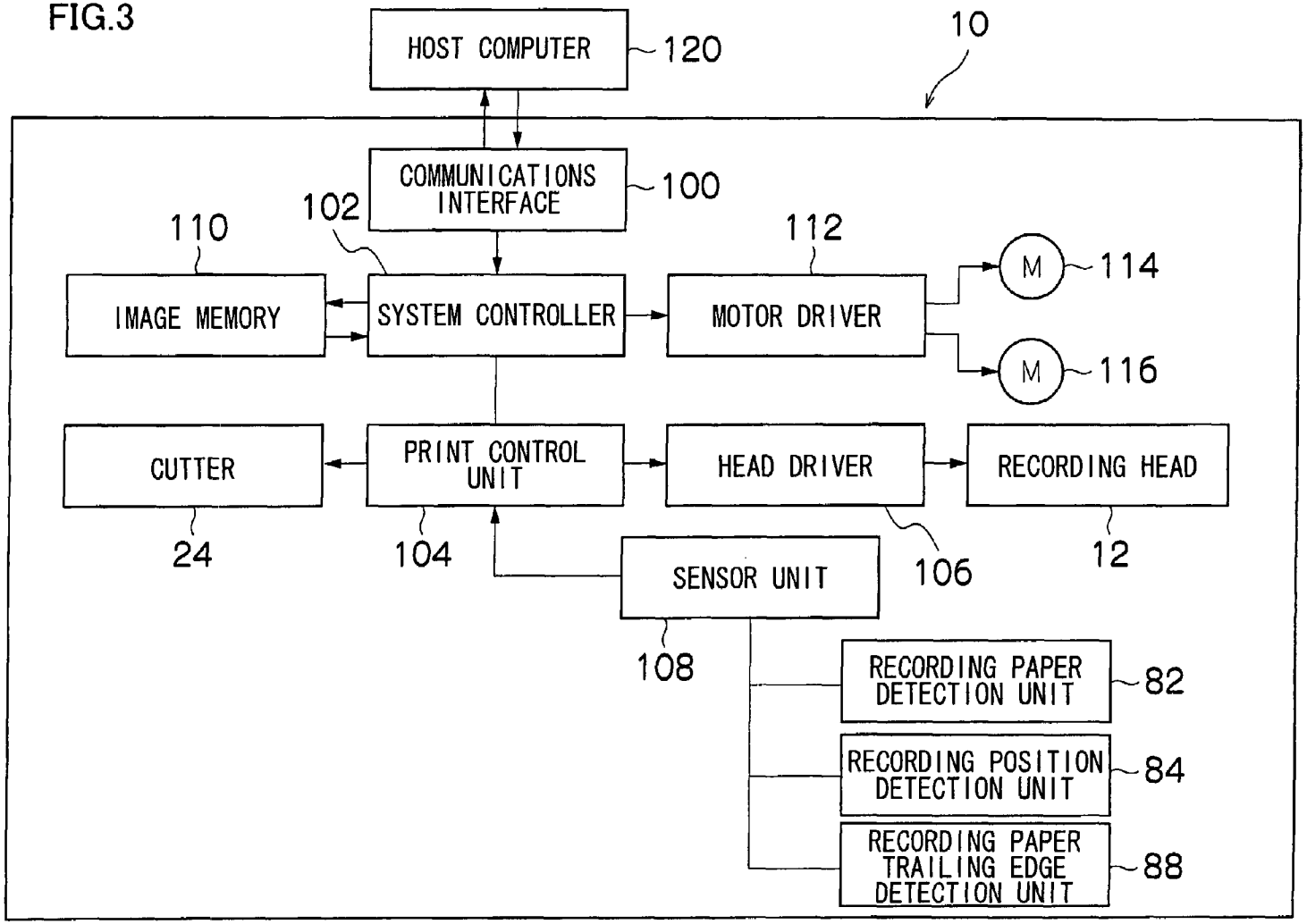
FIG. 3 is a control block diagram of an image forming apparatus relating to an embodiment of the present invention.

FIG. 3 is a principal block diagram showing the system composition of the image forming apparatus 10. The image forming apparatus 10 comprises a communications interface 100, a system controller 102, a print control unit 104, a head driver 106, and the like.

The communications interface 100 is an interface unit for receiving image data transmitted by a host computer 120. For the communications interface 100, a serial interface, such as USB, IEEE 1394, the Internet, or a wireless network, or the like, or a parallel interface, such as Centronics, or the like, can be used. Image data sent from a host computer 120 is read into the image forming apparatus 10 via the communications interface 100, and it is stored temporarily in the image memory 110. The image memory 110 is a storage device for temporarily storing input image data, and reading and writing of the image data is carried out via the system controller 102.

The system controller 102 is a control unit for controlling the communications interface 100, the image memory 110, the motor driver 112, and the like. More specifically, the system controller 102 is constituted by a central processing unit (CPU) and peripheral circuits thereof, and the like, and in addition to controlling communications with the host computer 120 and controlling reading and writing of the image memory 110, or the like, it also generates a control signal for controlling conveyance of the recording paper 12 by means of the motors 114, 116, and the like.

The motor driver 112 is a driver which drives the motors 114, 116 in accordance with instructions from the system controller 102.

The print control unit 104 is a control unit for controlling various sections, such as the head driver 106, the cutter 24, and the like, on the basis of the detection results from the sensor unit 108. In accordance with the control implemented by the system controller 102, the print control unit 104 performs various treatment processes, and the like, in order generate a signal for controlling recording, from the image data in the image memory 110, and it supplies the recording control signal (image data) thus generated to the head driver 106. The head driver 106 drives the recording heads corresponding to various colures in the recording head 12 (K, C, M, Y), on the basis of the recording data supplied from the print control unit 104.

Figure 4:
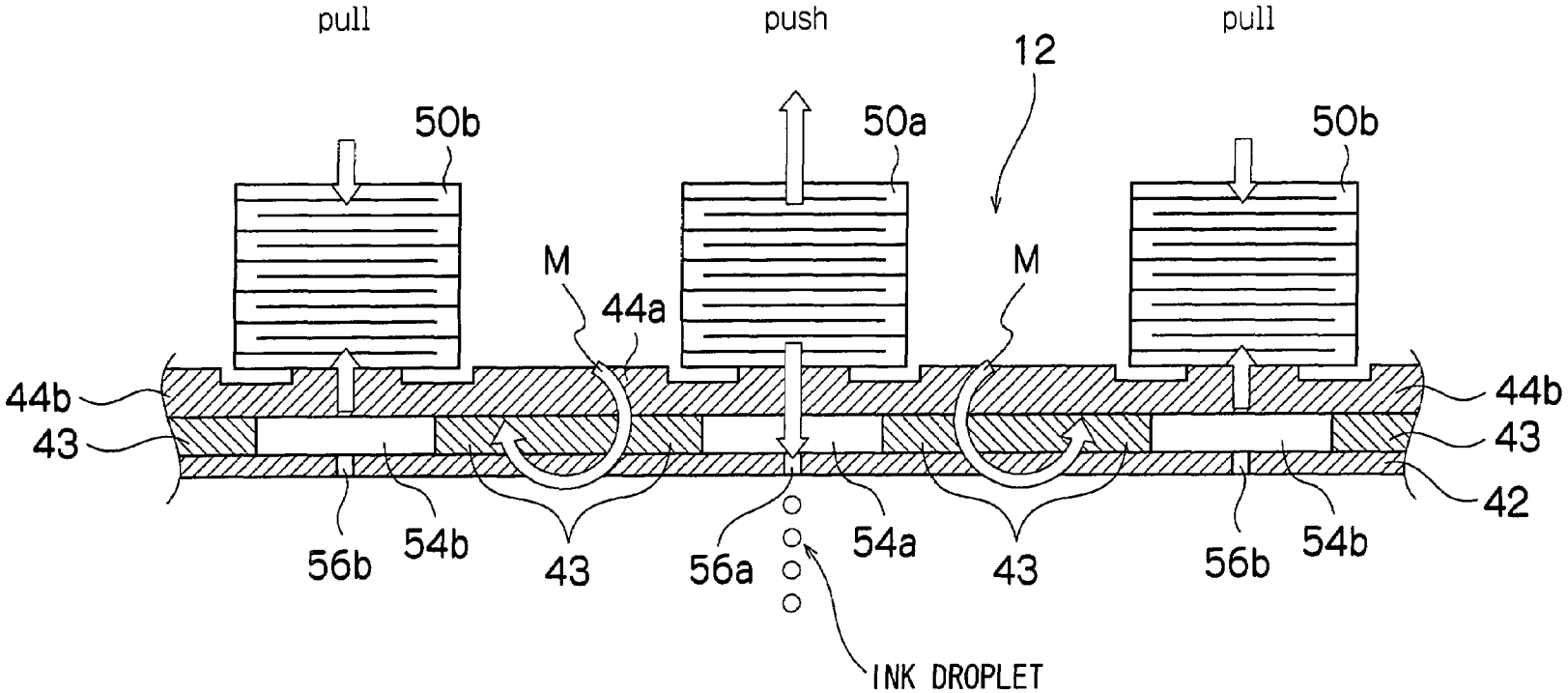
FIG. 4 is a descriptive diagram showing the drive voltage applied to piezoelectric elements of an image forming apparatus relating to an embodiment of the present invention.

Furthermore, as illustrated in FIG. 4 described hereinafter, the print control unit 104 supplies a drive signal for supplying to the piezoelectric elements 50*b* of the nozzles 56*b* adjacent to the discharging nozzle 56*a*, to the head driver 106.

The sensor unit 108 provided in the print control unit 104 is a block comprising the aforementioned recording paper detection unit 82, the recording position detection unit 84, the recording paper trailing end detection unit 88, and the detection results obtained by these various detection units are supplied to the print control unit 104. In the print control unit 104, prescribed calculational processes are carried out on the basis of the detection results obtained by the respective detection units, and these detection results are supplied to the system controller 102. More specifically, the timing of cutting the recording paper 12 by means of a cutter 24, and the like, is determined on the basis of the detection results from the recording paper detection unit 82.

Next, the ink discharging operation of the recording head 12 having the composition described above will be explained.

In FIG. 4, the central nozzle is taken to be a discharging nozzle 56*a*, the nozzles adjacent to this discharging nozzle 56*a* on the front and rear sides, and left and right-hand sides, are taken to be non-discharging nozzles 56*b*, and the piezoelectric elements corresponding to the discharging nozzle 56*a* and the non-discharging nozzles 56*b* are indicated respectively by the numerals 50*a*, 50*b*, and the vibration plates corresponding to same are indicated respectively by the numerals 44*a*, 44*b*. Furthermore, a drive voltage is applied as a drive voltage pulse having a drive waveform based on an image forming pattern.

Figure 5:
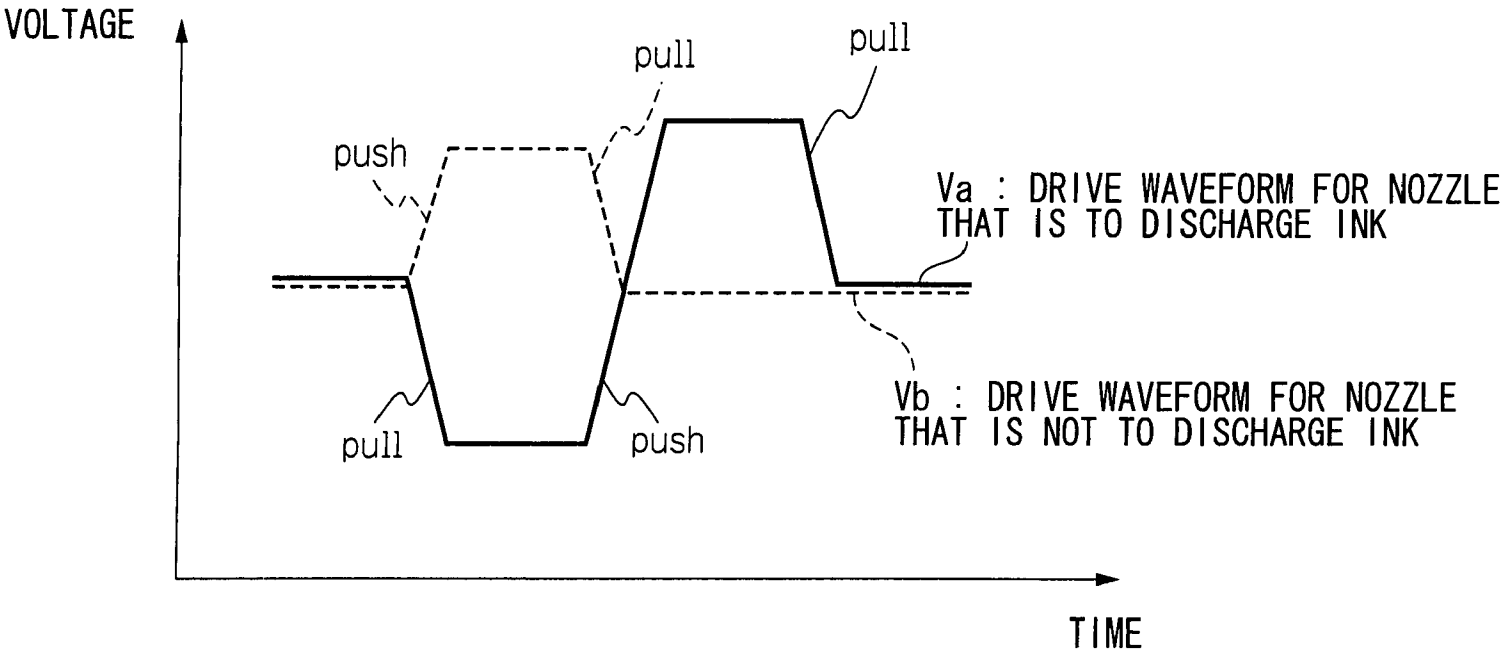
FIG. 5 is a side view showing the action of an image forming apparatus relating to an embodiment of the present invention.

In order to form an image on the basis of an image forming pattern, a drive voltage is applied to the piezoelectric elements 50*a*, in accordance with a system controller. As shown in FIG. 5, the voltage waveform Va is a drive voltage applied to the piezoelectric element 50*a* of the nozzle 56*a* which is discharging ink, and the voltage waveform Vb is a drive voltage applied to the piezoelectric elements 50*b* of the non-discharging nozzles 56*b* which do not discharge ink.

In FIG. 4, when a drive voltage is applied to the piezoelectric element 50*a* of the discharging nozzle 56*a*, the piezoelectric element 50*a* performs an expanding deformation in the vertical direction in FIG. 4, the vibration plate 44*a* bends downward, and the pressure chamber 54*a* of the discharging nozzle 56*a* is constricted and discharges ink. If a voltage Vbpull is applied to the piezoelectric elements 50*b* of the adjacent non-discharging nozzles 56*b*, in a virtually simultaneous fashion to the application of the voltage Vapush, then the piezoelectric elements 50*b* perform a contracting deformation in the vertical direction in FIG. 4, whereby the vibration plates 44*b* are caused to bend upward. A turning moment M is applied to the respective boundary regions of the vibration plates 44*a*, 44*b* positioned between the discharging nozzle 56*a* and the non-discharging nozzles 56*b*, and upward and downward movement of the pressure chamber 54*a* is prevented thereby.

Here, the voltage waveform Vb illustrated in FIG. 5 should be of a phase which generates a turning moment M in the vibration plate 44*a*, by means of a portion of the drive waveform, and it does not have to be of a completely inverse phase.

Furthermore, the voltage waveform Vb may partially include a component that is inverse to the drive sequence of the voltage waveform Va.

Figure 6B:
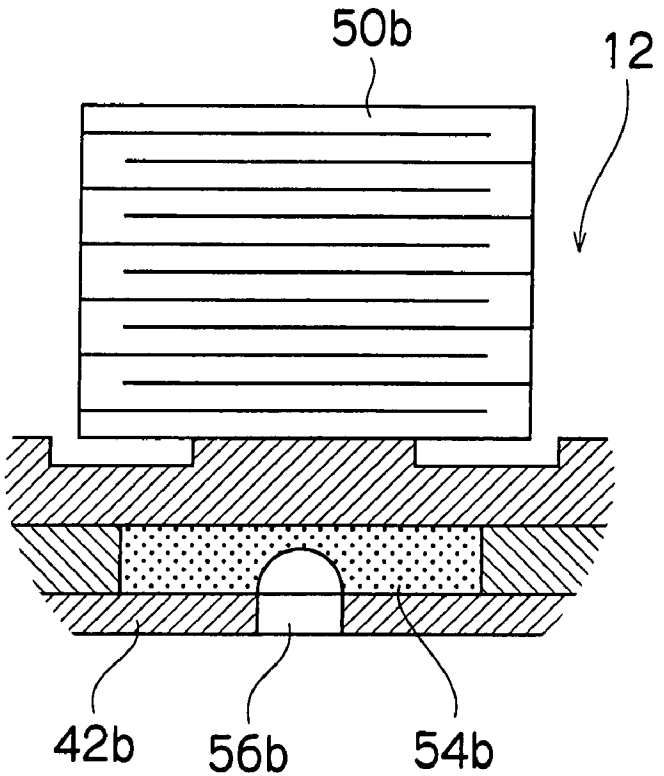
FIGS. 6A and 6B are descriptive diagrams showing the nozzle discharge limit and the air bubble introduction limit.
Figure 6A:
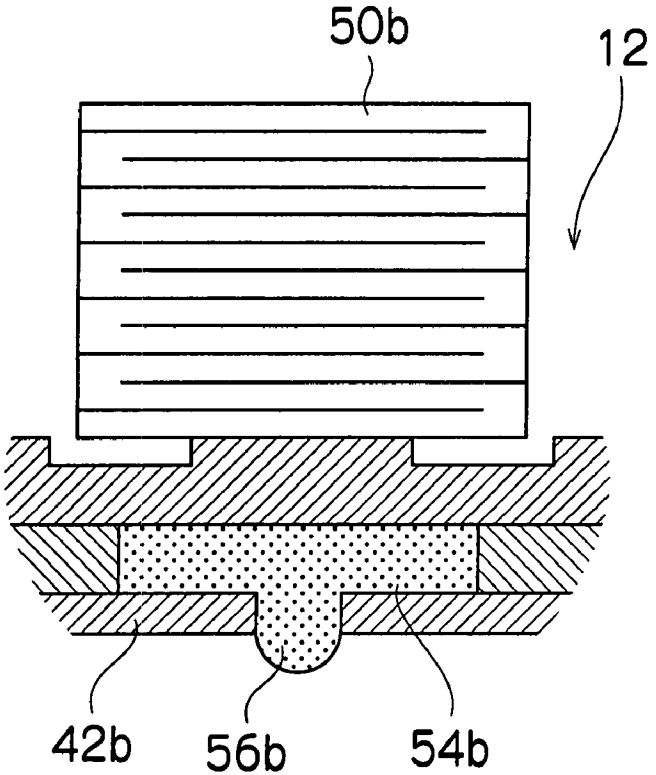

The maximum voltage of the voltage waveform Vb applied to the piezoelectric elements 50*b* of the non-discharging nozzles 56*b* is a drive voltage of a level whereby air bubbles do not infiltrate into the pressure chamber 54, or whereby ink is not discharged. In cases which exceed either the state shown in FIG. 6A, wherein ink is caused to project in an approximately hemispherical shape externally from the nozzle 56*b*, with respect to the nozzle plate 42*b*, or the state shown in FIG. 6B, wherein an air bubble projects inside the pressure chamber 54*b* from the nozzle plate 42*b*, then an accidental droplet will be ejected, or an air bubble will be introduced into the pressure chamber 54. If the pressure differential between the inner side and outer side of the nozzles 56 in this case is taken to be ΔP (where ΔP=2T/r, taking T as the surface tension of the ink and r as the nozzle radius), the ink leakage occurs when the internal pressure minus the external pressure is greater than or equal to ΔP, and an air bubble is introduced into the pressure chamber 54 when the external pressure minus the internal pressure is greater than or equal to ΔP. In practice, the circumstances are also affected by the angle of contact between the ink and the nozzle, and the shape of the nozzle, and the like, and therefore a drive voltage is applied to a level whereby the pressure difference ΔP is at least restricted to approximately one half the value of 2T/r.

According to the image forming apparatus of the present embodiment, turning moments M are applied to the vibration plate 44 positioned between a discharging nozzle and non-discharging nozzles, thereby preventing upward and downward movement of the pressure chamber 54*a*, and hence making it possible to improve ink discharge efficiency. By this means, not only is it possible to use ink of high viscosity, but furthermore, higher density in the head can also be achieved.

The piezoelectric elements are not limited to a configuration wherein laminated piezoelectric bodies are separated mechanically for each pressure chamber, and a mode wherein the piezoelectric elements are driven independently for each pressure chamber by means of the electrode pattern of the laminated piezoelectric bodies, or a unimorph structure (single-plate piezoelectric element) may also be adopted.

Furthermore, it is also possible to apply a drive voltage for inverse driving to the non-discharging nozzles situated two or more positions apart from the discharging nozzle, in the front/rear and left/right directions, and not only to the non-discharging nozzles situated immediately to the front, rear, left-hand side and right-hand side of the discharging nozzle.

In other words, referring to FIG. 4, the example is described as driving the piezoelectric elements 50*b* of the non-discharging nozzle 56*b* which is adjacent to the discharging nozzle 56*a* to an inverse direction of the piezoelectric element 50*a* of the discharging nozzle 56*a*, but there is another possibility of an embodiment wherein the piezoelectric elements (not illustrated in FIG. 4) of the non-discharging nozzle (not illustrated) which is neighborhood of the discharging nozzle 56*a* and is not adjacent to the discharging nozzle 56*a*, are driven to an inverse direction of piezoelectric element 50*a* of the discharging nozzle 56*a*.

Figure 7:
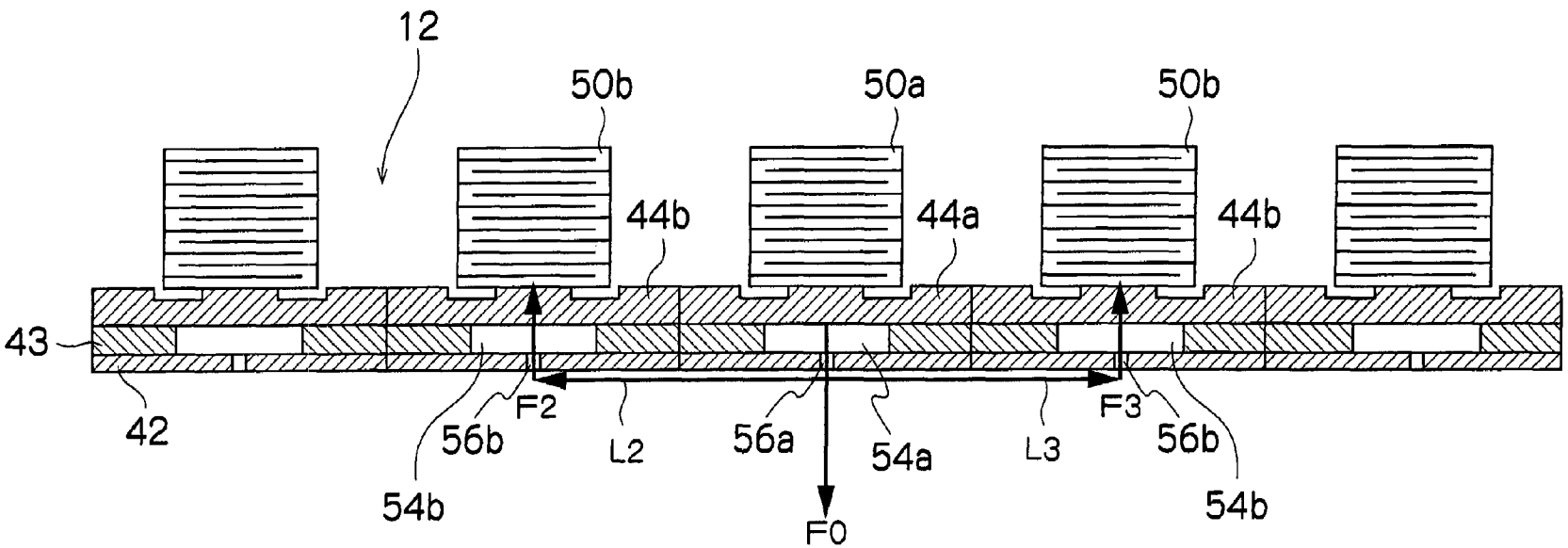
FIG. 7 is a descriptive diagram showing the action in case of driving the non-discharging nozzles which are neighborhood of a nozzle discharging ink.

As shown FIG. 7, when the downward force F0 in FIG. 7 is generated by applying the push waveform of the voltage waveform Va (drive waveform) explained in FIG. 5 to the piezoelectric elements 50*a* which are disposed corresponding to the pressure chamber 54*a* of the discharging nozzle 56*a* (center in FIG. 7), the pull waveform of the voltage waveform Vb is applied to each of the piezoelectric elements 50*b* corresponding to the non-discharging nozzles 56*b* which is adjacent to the discharging nozzle 56*a*, to generate the forces F2 and F3 in an inverse direction (upward) to F0, as described in FIG. 4.

At this time, it is important to prevent applying the bending stress to the recording head 12 by balancing out the moment of the force applying to recording head 12 to attain accurate discharge. As shown in FIG. 7, if the piezoelectric elements 50*b* of non-discharging nozzles 56*b* which are adjacent to the discharging nozzle 56*a* are driven, it is desirable to arrange the nozzles 56*a* and 56*b* in accordance with F2×L2=F3×L3 when the distance between adjacent discharging nozzles is L2 and L3 (L2=L3=nozzle pitch).

Figure 8:
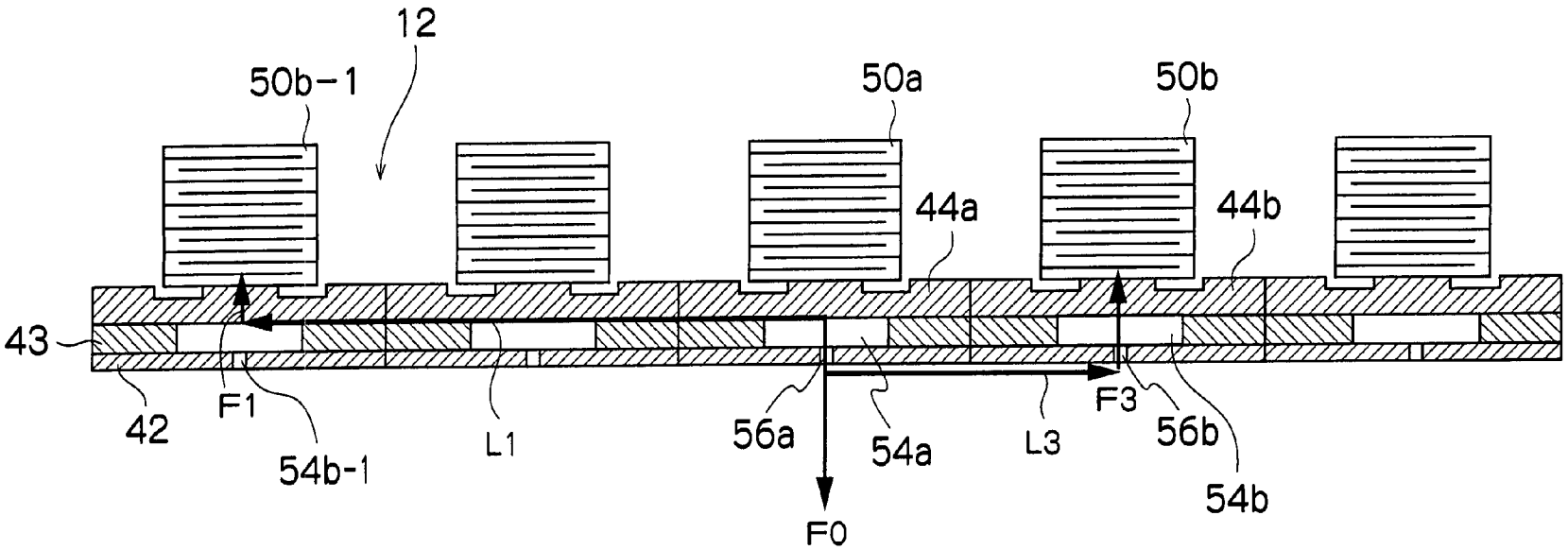
FIG. 8 is a descriptive diagram showing the action in case of driving the non-discharging nozzles, which are not neighborhood of a nozzle discharging ink.

Similarly, if the non-adjacent piezoelectric elements are driven, it is desirable to control the force for balancing out the moments corresponding to the distance. For example, in FIG. 8, if the forces F1 and F3 in an inverse direction to the F0 is generated by driving the piezoelectric elements 50*b*-1 corresponding to the non-discharging nozzle 54*b*-1 in the distance of L1 which is not adjacent to the discharging nozzle 56*a*, and the piezoelectric elements 50*b* corresponding to the non-discharging nozzle 56*b* in the distance of L3 which is adjacent to the discharging nozzle 56*a*, it is desirable to control the force to establish F1×L1=F3×L3. Here, when L1=2×L3 is established, $$F1 = \frac{F3}{2}$$

is denoted.

Figure 9:
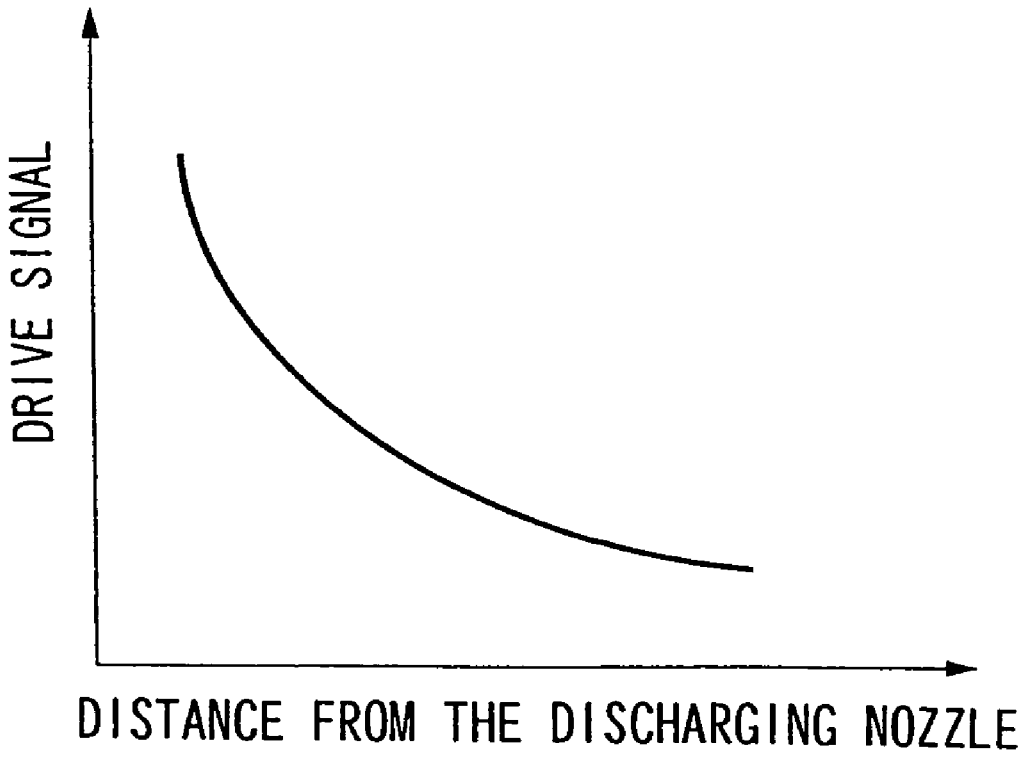
FIG. 9 is a graph showing the relation between the distance from the discharged nozzle and the magnitude of drive signal to the piezoelectric elements.

By the relation mentioned above, the relationship between the distance from the discharging nozzle and the magnitude (voltage value) of drive signal to the piezoelectric elements is inverse proportion approximately (L×F=constant value), as shown in FIG. 9.

Furthermore, if a plurality of nozzles are arranged in a two-dimensional staggered matrix arrangement, it is also possible to apply a drive voltage for inverse driving to the piezoelectric elements of nozzles that are adjacent to the discharging nozzle in an oblique direction, and not only in the front/rear and left/right directions. Moreover, the magnitude of the drive voltage applied to the piezoelectric elements 50*b* can be changed according to the distance from the discharging nozzle 56*a* (referring in FIG. 9).

Furthermore, it is also possible to provide a dummy piezoelectric element which does not contribute to image forming, on the outer side of the nozzle positioned on the outermost side, in order to impart a turning moment to the vibration plate of the nozzle positioned on the outermost side. An example is shown in FIG. 10.

Figure 10:
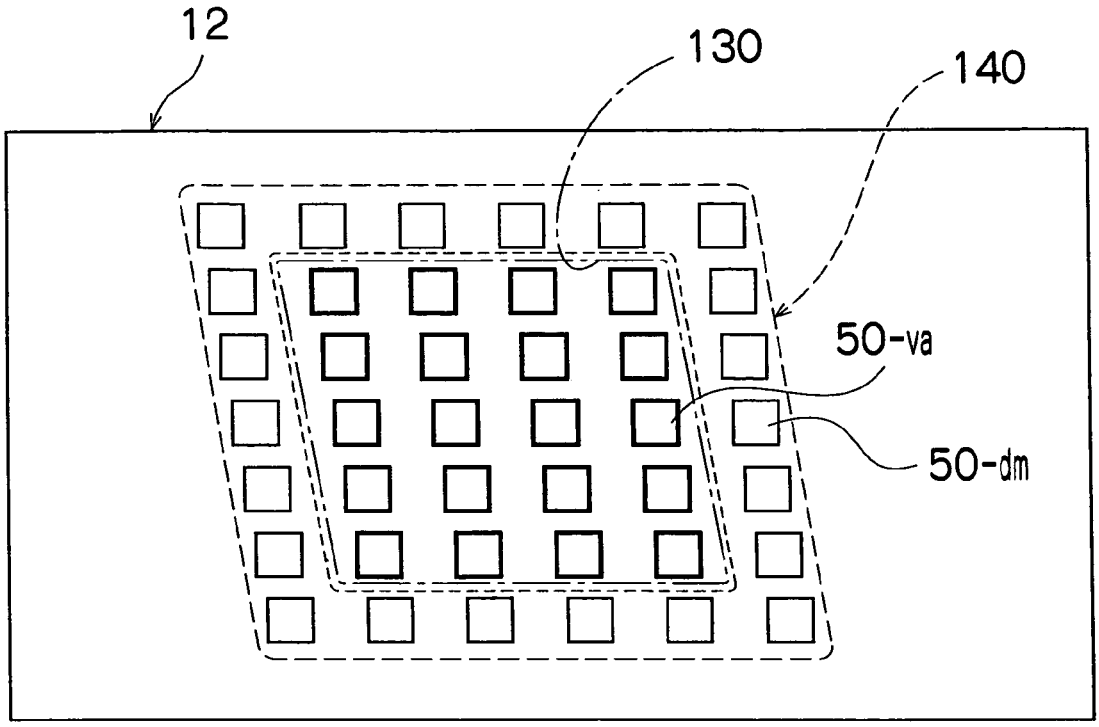
FIG. 10 is a plan diagram showing an embodiment of arrangement of the dummy piezoelectric elements.

FIG. 10 is a plan diagram showing the recording head arranged in two-dimensional matrix fashion. The area 130 surrounded by a dash and dotted line in the diagram is the area (called as "effective nozzle area" in following portion) arranging the piezoelectric elements 50-va corresponding to pressure chamber of nozzle used to discharge ink for printing (nozzle to cause the image forming). Dummy piezoelectric elements 50-dm that dose not contribute image formation are provided on outside of this effective nozzle area (the area 140 surrounded by dotted lines in the diagram).

The above description makes the fact clear that the moments can be balanced out by driving the dummy piezoelectric elements 50-dm when the discharge is performed from the nozzle of the outermost direction in the effective nozzle area 130.

It should be understood, however, that there is no intention to limit the invention to the specific forms disclosed, but on the contrary, the invention is to cover all modifications, alternate constructions and equivalents failing within the spirit and scope of the invention as expressed in the appended claims.

What is claimed is:

1. An image forming apparatus, comprising:

a plurality of nozzles arranged in a line fashion or a two-dimensional fashion;

a plurality of pressure chambers arranged respectively corresponding to the nozzles;

a plurality of piezoelectric elements each of which causes ink to be discharged from a respective nozzle by imparting pressure to an interior of the pressure chamber corresponding to the nozzle during application of a drive signal to the corresponding piezoelectric element; and a controller for controlling a magnitude of the drive signal supplied to the piezoelectric element of the nozzle discharging the ink as well as the magnitude of another drive signal supplied to the piezoelectric element of a non-discharging nozzle neighboring the nozzle discharging the ink, wherein, when one nozzle discharges the ink, the other drive signal is supplied to the piezoelectric element of a non-discharging nozzle neighboring the nozzle discharging the ink, the other drive signal including a drive component for driving the piezoelectric element of the non-discharging nozzle in a direction inverse to the direction that the piezoelectric element of the nozzle discharging the ink is driven, and the controller controls a magnitude of the other drive signal supplied to the piezoelectric element of the non-discharging nozzle is determined in accordance with distance between the non-discharging nozzle and the discharging nozzle such that the further away from the nozzle discharging the ink, the smaller is the magnitude of the other drive signal supplied to the piezoelectric element of the non-discharging nozzle neighboring the nozzle discharging the ink.

2. The image forming apparatus according to claim 1, wherein at least a portion of a drive waveform included in the other drive signal supplied to the piezoelectric element of the non-discharging nozzle is of inverse phase to a drive waveform included in the drive signal for the piezoelectric element of the discharging nozzle.

3. The image forming apparatus according to claim 2, further comprising a dummy piezoelectric element that does not contribute to image formation arranged on outer side of the nozzles in outermost positions.

4. The image forming apparatus according to claim 2, further comprising a dummy piezoelectric element that does not contribute to image formation arranged on outer side of the nozzles in outermost positions.

5. The image forming apparatus according to claim 1, further comprising a dummy piezoelectric element that does not contribute to image formation arranged on outer side of the nozzles in outermost positions.

6. The image forming apparatus according to claim 1, wherein a moment of force applying to the image forming apparatus is balanced between the nozzle discharging the ink and the non-discharging nozzle neighboring the nozzle discharging the ink.

7. An image forming apparatus comprising a recording head including:

a plurality of nozzles arranged in a two-dimensional fashion;

a plurality of pressure chambers arranged respectively corresponding to the nozzles;

a plurality of piezoelectric elements each of which causes ink to be discharged from a respective nozzle by imparting pressure to an interior of the pressure chamber corresponding to the nozzle during application of a drive signal to the corresponding piezoelectric element; and a controller for supplying drive signals to piezoelectric elements, for controlling a magnitude of a drive signal supplied to the piezoelectric element of the nozzle discharging the ink and for controlling the magnitude of a drive signal supplied to the piezoelectric element of a non-discharging nozzle neighboring the nozzle discharging the ink, wherein a moment of force applying to the recording head is balanced in a two-dimensional fashion between the nozzle discharging the ink and non-discharging nozzles that are adjacent to the nozzle discharging the ink on front, rear, left-hand and right-hand sides thereof, by the controller supplying the drive signal to the piezoelectric element of the nozzle discharging the ink simultaneously with supplying each of the non-discharging nozzles with a drive signal whose drive waveform includes a drive component that has at least partly an inverse phase to a drive waveform of the drive signal supplied to the piezoelectric element of the nozzle discharging the ink, in such a manner that the piezoelectric element of each of the non-discharging nozzles is driven in a direction inverse to a direction in which the piezoelectric element of the nozzle discharging the ink is driven, and the controller controls the magnitude of the drive signal supplied to the piezoelectric element of the non-discharging nozzle such that the further away from the nozzle discharging the ink, the smaller is the magnitude of the drive signal supplied to the piezoelectric element of each of the non-discharging nozzles.

* * * * *